US005466924A

United States Patent [19]

Van Aller

[11] Patent Number: 5,466,924

[45] Date of Patent: Nov. 14, 1995

[54] IMAGE INTENSIFIER TUBE WITH ENTRANCE SCREEN PHOTOCATHODE WHICH IS INSENSITIVE TO LIGHT EMITTED BY THE EXIT SCREEN PHOSPHOR LAYER

[75] Inventor: Gerardus Van Aller, Waalre, Netherlands

[73] Assignee: U.S. Philips Corporation, Tarrytown, N.Y.

[21] Appl. No.: 275,047

[22] Filed: Jul. 13, 1994

[30] Foreign Application Priority Data

Jul. 13, 1993 [DE] Germany ..... 09 30 072.1

[51] Int. Cl.[6] ..... H01J 40/14

[52] U.S. Cl. ..... 250/214 VT; 313/526

[58] Field of Search ..... 250/214 VT; 313/526

[56] References Cited

U.S. PATENT DOCUMENTS

| | | | |
|---|---|---|---|
| 2,681,420 | 6/1954 | Teves et al. | 313/65 |
| 3,370,172 | 2/1968 | Hora | 250/83.3 |
| 3,569,763 | 3/1971 | Kiuchi | 313/65 |
| 4,140,900 | 2/1979 | Wang | 250/213 VT |
| 4,725,724 | 2/1988 | Van Der Velden | 250/213 VT |
| 4,752,681 | 6/1988 | Anno et al. | 250/214 VT |
| 5,025,144 | 6/1971 | Odom et al. | 250/207 |
| 5,138,147 | 8/1992 | Van Aller et al. | 250/213 VT |

FOREIGN PATENT DOCUMENTS 9000267 9/1991 Netherlands .

*Primary Examiner*—Edward P. Westin
*Assistant Examiner*—Stephen Calogero
*Attorney, Agent, or Firm*—Leroy Eason

[57] ABSTRACT

A proximity-type image intensifier tube has an entrance screen which includes a photocathode which is substantially insensitive to light of wavelengths above 500 nm, and an exit screen having a phosphor layer having a substantial emissivity of notably red light having a wavelength of at least 550 nm. Consequently, optical radiation produced by the exit screen does not produce disturbing feedback radiation from the photocathode. This avoids the need for a reflecting metallic layer on the phosphor layer, as has heretofore been required in order to prevent feedback radiation.

10 Claims, 1 Drawing Sheet

IMAGE INTENSIFIER TUBE WITH ENTRANCE SCREEN PHOTOCATHODE WHICH IS INSENSITIVE TO LIGHT EMITTED BY THE EXIT SCREEN PHOSPHOR LAYER

BACKGROUND OF THE INVENTION

1. Field of the Invention

The invention relates to an image intensifier tube comprising an entrance screen with a photocathode and an exit screen with a phosphor layer for converting photoelectrons from the photocathode into radiation, which exit screen comprises an image detection matrix for deriving an electronic signal from the radiation.

2. Description of the Related Art

An image intensifier tube of this kind is known from NL 90 00 267 (PHN 13.212) laid open to public inspection.

The known image intensifier tube is an X-ray image intensifier tube in which an image-carrying X-ray beam is converted into light which is incident on the photocathode so as to generate an image-carrying electron beam. A vacuum exists in the gastight envelope in order to minimize electron beam scattering. The image-carrying electron beam is imaged on the phosphor layer by the electron-optical system. The electron beam incident on the phosphor layer generates light therein, which light is emitted by the photocathode. The light generated in the phosphor layer is emitted in the forward direction towards the image detection matrix in which the image information is converted into an electronic image signal. If no steps are taken, the phosphor layer also emits light in the backward direction, i.e. towards the photocathode. The light emitted in the backward direction by the phosphor layer and incident on the photocathode generates an additional, disturbing electron beam. The phosphor layer also converts the additional, disturbing electron beam into light which is detected by the image detection matrix and thus disturbs the electronic image signal.

U.S. Pat. No. 4,140,900, issued Feb. 20, 1979, discloses a reflecting aluminium layer provided on the phosphor layer of an X-ray image intensifier tube. Such a reflecting layer ensures that light emitted backwards by the phosphor layer cannot reach the photocathode. Providing an aluminium reflecting layer on the phosphor layer when the latter has been provided on a semiconductor image detection matrix, however, is not possible by means of known technology. The deposition of such an aluminium reflecting layer requires a process step during which the phosphor layer with the image detection matrix is exposed to a high temperature, notably higher than 400° C. When a semiconductor image detection matrix is exposed to a temperature higher than 200° C., the operation of the image detection matrix will be affected.

SUMMARY OF THE INVENTION

It is inter alia an object of the invention to provide an image intensifier tube comprising an image detection matrix in which emission of electrons by the photocathode due to light emitted by the phosphor layer in the direction of the photocathode is at least substantially avoided.

This object is achieved in an image intensifier tube in accordance with the invention which is characterized in that the phosphor layer is composed of a phosphor material for emitting radiation whereto the photocathode is substantially insensitive.

The use of a phosphor layer which, in response to activation by an image-carrying electron beam, emits light of a wavelength in a range whereto the photocathode is substantially insensitive, prevents the photocathode from emitting an additional, disturbing electron beam due to light originating from the phosphor layer. Activation of the phosphor layer by such an additional, disturbing electron beam is thus avoided, and hence also the disturbing of the electronic image signal.

An embodiment of an image intensifier tube in accordance with the invention, in which the sensitivity of the photocathode is highest to light of a wavelength of less than 550 nm, is characterized in that the phosphor layer is composed of a phosphor material for the emission of light of a wavelength of at least 550 nm.

A photocathode for use in an image intensifier tube usually is substantially sensitive to light of a wavelength in a range of from approximately 300 nm to approximately 500 nm, whereas the sensitivity decreases strongly for wavelengths greater than 500 nm. By utilizing a phosphor layer exhibiting a substantial emissivity of light of a wavelength greater than approximately 550 nm, it is achieved that, when light emitted by the phosphor layer reaches the photocathode, the photocathode does not emit electrons, or hardly so, in response to light originating from the phosphor layer.

A phosphor layer exhibiting a an emissivity of notably red light having a wavelength greater than approximately 550 nm is realised by using europium-doped yttrium oxide as the phosphor material.

A further embodiment of an image intensifier tube in accordance with the invention is characterized in that the exit screen includes an intermediate layer of indium-tin oxide.

The phosphor layer receives high-energy electrons from the photocathode. The electrons partly transfer their energy to the phosphor layer which emits light in response thereto. In order to avoid electrical charging of the phosphor layer by the electrons, an electrically conductive intermediate layer which is transparent to the light emitted by the phosphor layer is provided between the phosphor layer and an image detection matrix. The intermediate layer is preferably made of indium-tin oxide and is connected to, for example the envelope of the X-ray image intensifier tube so as to discharge the electrons.

A further embodiment of an image intensifier tube is characterized in that the image intensifier tube is of the proximity type in which the surface dimensions of the entrance screen and the exit screen are substantially equal.

A proximity-type image intensifier tube, being known per se from U.S. Pat. No. 4,140,900, is essentially panel-shaped and comprises an entrance screen and an exit screen of substantially the same dimensions. In comparison with other image intensifier tubes, such a proximity-type image intensifier tube has a comparatively large angle of aperture, i.e. a proximity-type image intensifier tube is sensitive to X-rays incident on the entrance screen at a comparatively large angle. Furthermore, a proximity-type image intensifier tube comprises an exit screen having a comparatively large surface area. As a result, such an X-ray image intensifier tube is attractive for use in conjunction with an image detection matrix, because an image detection matrix may have a surface area which is larger than that of, for example a CCD image sensor.

BRIEF DESCRIPTION OF THE DRAWING

These and other aspects of the invention will be described with reference to the sole accompanying drawing; therein.

DESCRIPTION OF THE PREFERRED EMBODIMENTS

Figure 1:
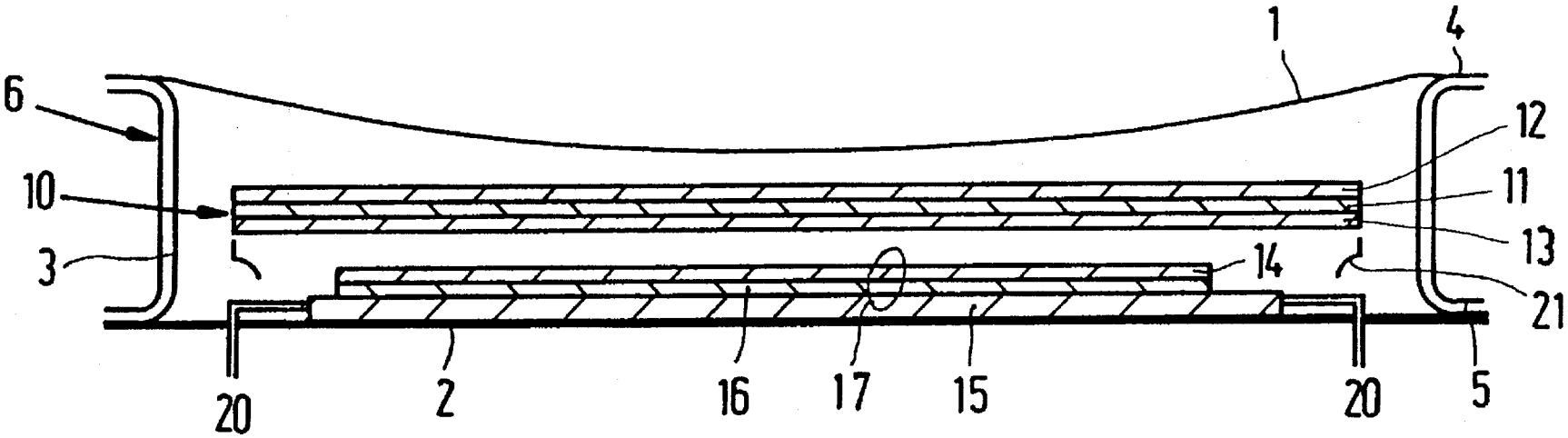
FIG. 1 shows diagrammatically a proximity-type image intensifier tube in accordance with the invention.

FIG. 1 is a side elevation of a proximity-type image intensifier tube in accordance with the invention, comprising an entrance window 1 and an exit wall portion 2 which serves as a supporting plate and which may, therefore, be a metal plate. The entrance window and the exit wall portion are joined by means of a cylindrical casing portion 3. Using joints 4 and 5, the entrance window 1, the exit wall portion 2 and the sleeve portion 3 are assembled to form an envelope 6 to be evacuated, which envelope has a thickness of, for example approximately 5 cm and a diameter of, for example approximately 40 cm. In the envelope there are provided an entrance screen 10 with, provided on a support 11, a conversion layer 12 and a photocathode 13. The image intensifier tube in accordance with the invention is suitable as an X-ray image intensifier tube because the entrance screen is provided with a conversion layer which is sensitive to X-rays. The support 11 is made of, for example aluminium and the conversion layer preferably contains Na-doped or Tl-doped CsI. The photocathode 13 comprises a layer of antimony doped with an alkali metal and deposited on the support 11. At a distance of from, for example 0.5 to 1.0 cm from the photocathode there are arranged an exit screen 17 with a phosphor layer 14 and a semiconductor image detection matrix 15 which is separated from the phosphor layer by an intermediate layer 16. The intermediate layer is preferably a light-transparent and electrically conductive indium-tin oxide layer. The image detection matrix 15 can be read out in a location-sensitive manner via passages 20.

The conversion layer 12 converts image-carrying X-rays into image-carrying light of a wavelength in, for example the range of from 300 nm to 500 nm. The photocathode 13 converts the image-carrying light into an image-carrying electron beam which is imaged on the phosphor layer 14 by an electro-optical system 21. The electron image imaged on the phosphor layer is converted into a light image which is converted into an electronic image signal by the image detection matrix 15. The electrons incident on the phosphor layer are discharged by the intermediate layer 16 after having caused emission of light quanta in the phosphor layer. In order to prevent light emitted by the phosphor layer in the direction of the photocathode from causing the emission of an additional, disturbing electron beam by the photocathode, in an X-ray image intensifier tube in accordance with the invention the wavelength range of the light emitted by the phosphor layer deviates substantially from the wavelength range whereto the photocathode is sensitive. Consequently, light emitted by the phosphor layer in the direction of the photocathode does not cause any significant emission of electrons by the photocathode, so that disturbances of the image signal by an additional, disturbing electron beam are counteracted.

A customary photocathode, comprising an antimony layer doped with an alkali metal, for use in an X-ray image intensifier tube is sensitive to light of a wavelength of between 300 nm and 500 nm. By using a phosphor layer which principally generates light of a wavelength greater than 550 nm, it is achieved that the light emitted by the phosphor layer does not significantly release electrons from the photocathode. By using a phosphor layer containing europium-doped yttrium oxide, a phosphor layer is realised with emission of red light whereto the photocathode is substantially insensitive.

The Figure does not show further details of the image detection matrix 15. An image detection matrix 15 preferably has an orthogonal structure of, for example approximately 2000×2000 pixels, each of which is dimensioned, for example 0.2 mm×0.2 mm and also comprises light-sensitive element, for example a photodiode with which a read-out switch, for example a thin-film transistor, is associated. The image detection matrix also comprises read lines and addressing lines, so that each pixel can be individually influenced. The image detection matrix can be read out column-wise by activation of the addressing lines. To this end, the addressing lines are activated to close the read out switches in successive rows and to apply the successive charges formed in the photodiodes by exposure column-wise to a read out register.

What is claimed is:

1. An image intensifier tube comprising:

an entrance screen having a photocathode which emits photoelectrons in response to radiation incident thereon having a wavelength within a predetermined wavelength range; and an exit screen having a phosphor layer which emits radiation in response to photoelectrons from the photocathode, and further having an image detection matrix for deriving an electronic signal in response to the radiation from the phosphor layer;

the phosphor layer being composed of a phosphor material such that the radiation emitted thereby is principally outside said predetermined wavelength range;

whereby feedback of the radiation from the phosphor layer to the photocathode does not cause increased emission of photoelectrons by the photocathode.

2. An image intensifier tube as claimed in claim 1, wherein said predetermined wavelength range is below 550 nm.

3. An image intensifier tube as claimed in claim 2, characterized in that the phosphor material consists of europium-doped yttrium oxide.

4. An image intensifier tube as claimed in claim 1, characterized in that the exit screen includes an intermediate layer of indium-tin oxide.

5. An image intensifier tube as claimed in claims 1, characterized in that the image intensifier tube is of the proximity type in which the entrance screen and the exit screen have substantially the same surface dimensions.

6. An image intensifier tube as claimed in claim 2, characterized in that the exit screen includes an intermediate layer of indium-tin-oxide.

7. An image intensifier tube as claimed in claim 3, characterized in that the exit screen includes an intermediate layer of indium-tin-oxide.

8. An image intensifier tube as claimed in claim 2, characterized in that the image intensifier tube is of the proximity type in which the entrance screen and the exit screen have substantially the same surface dimension.

9. An image intensifier tube as claimed in claim 3, characterized in that the image intensifier tube is of the proximity type in which the entrance screen and the exit screen have substantially the same surface dimension.

10. An image intensifier tube as claimed in claim 4, characterized in that the image intensifier tube is of the proximity type in which the entrance screen and the exit screen have substantially the same surface dimension.

* * * * *